US011337477B2

(12) United States Patent
Castillo

(10) Patent No.: US 11,337,477 B2
(45) Date of Patent: May 24, 2022

(54) WASHABLE HEAT CAP

(71) Applicant: Denise Castillo, Winter Park, FL (US)

(72) Inventor: Denise Castillo, Winter Park, FL (US)

( * ) Notice: Subject to any disclaimer, the term of this patent is extended or adjusted under 35 U.S.C. 154(b) by 65 days.

(21) Appl. No.: 16/860,042

(22) Filed: Apr. 27, 2020

(65) Prior Publication Data

US 2020/0337403 A1 Oct. 29, 2020

Related U.S. Application Data

(60) Provisional application No. 62/838,704, filed on Apr. 25, 2019.

(51) Int. Cl.
*A42B 1/008* (2021.01)

(52) U.S. Cl.
CPC ..... *A42B 1/008* (2013.01)

(58) Field of Classification Search
CPC ..... A42B 1/008
See application file for complete search history.

(56) References Cited

U.S. PATENT DOCUMENTS 5,327,585 A * 7/1994 Karlan ..... A42B 1/008 2/171.2
5,773,802 A * 6/1998 Graves ..... A45D 4/16 132/229
5,850,636 A * 12/1998 Reuven ..... A61F 7/02 2/174
2002/0100106 A1* 8/2002 Simmons ..... A42B 1/008 2/171.2
2003/0233697 A1* 12/2003 Tsai ..... A42B 1/008 2/209.13
2005/0034215 A1* 2/2005 Harrison ..... A42B 3/10 2/207
2005/0050611 A1* 3/2005 Donovan ..... A42C 5/04 2/174
2009/0151046 A1* 6/2009 Donovan ..... A42B 1/12 2/174
2010/0083421 A1* 4/2010 Cho ..... C09K 5/063 2/171.2
2012/0073031 A1* 3/2012 Horwitz ..... A42B 1/008 2/209.13
2013/0152274 A1* 6/2013 Welch ..... A42B 1/008 2/171.2
2020/0229526 A1* 7/2020 Santos ..... A42B 1/008
2020/0237042 A1* 7/2020 Lubin ..... A42B 1/008

* cited by examiner

*Primary Examiner* — Khaled Annis

(57) ABSTRACT

The present invention is a re-usable headwear with a removable heating pad insert. The removable heating pad insert is separable from the cap body, allowing the cap body to be washed by itself without damaging the heating pad insert. The heating pad insert is re-heatable through a microwave, allowing for multiple uses. The cap body contains an insert pocket and an insert opening. The heating pad insert is installed into the insert pocket through the insert pocket. The heating pad insert contains a plurality of heating media compartments, where each of the plurality of heating media compartments contains heating media. This heating media takes the form of microwavable flax seed that absorbs and retains the heat from the microwave.

7 Claims, 6 Drawing Sheets

WASHABLE HEAT CAP

The current application claims a priority to the U.S. Provisional Patent application Ser. No. 62/838,704 filed on Apr. 25, 2019. The current application is filed on Apr. 27, 2020 while Apr. 25, 2020 was on a weekend.

FIELD OF THE INVENTION

The present invention relates generally to a healthcare device, particularly a heat cap with a heatable insert.

BACKGROUND OF THE INVENTION

Presently, heat caps are known conventionally in the healthcare field, used for any number of reasons for the treatment of hair, scalp, head, the muscles therein and so on. Where conventionally, a heat cap is imparted heat by an extraneous heating means that requires the heat cap to be placed in a heated environment for an arbitrary amount of time. The most expedient heat infusion often resulting from heating by an extraneous microwave. However, a shortcoming of the conventional product is that they are generally un-washable and inevitably disposable as washing would damage the heat retentive elements. Where further they may become more detrimental to health than beneficial due to being un-washable and used in contact with a person's body. Further conventionally, a heat cap cannot incorporate vibrational imparting elements due to the homogenous nature of the heat cap in a disposably designed state, any element that is reactive to microwaves would be unsuitable for expedient use in such an environment and would elsewise require the conventional heat cap to be cooked in an oven, boiling water, or open flame to mitigate electron emissivity or volatility thereof.

It is an objective of the present invention to introduce a cap body that is durable and comprises preferably cloth or similar that permits washing of the present invention. While further the cap body comprises at least one flaxseed recess that may accommodate at least one flaxseed pouch selectively. Whereupon the user may remove the at least one flaxseed pouch prior to washing so as not to damage the heat retentive elements thereof. The present invention permits the selective addition and removal of flaxseed pouches to the cap body such that the cap body may be washed readily as opposed to discarded of and replaced.

SUMMARY OF THE INVENTION

The present invention is a headwear with heatable insert that comprises a cap body, an insert pocket, an insert opening, and a heating pad insert in the preferred embodiment of the present invention, the headwear with heatable insert may take the form of a heat cap that is suitable for various treatment and therapeutic applications. In the preferred embodiment of the present invention, the headwear with heatable insert is re-usable, allowing the user to separate the heating pad insert from the cap body. This allows the user to re-heat the heating pad insert through a suitable heating element such as a microwave. Additionally, this allows the user to wash the cap body separate from the heating pad insert. In the preferred embodiment of the present invention, the cap body can be made out of a washable material, such as, but not limited to cotton or any other suitable material.

In the preferred embodiment of the present invention, the insert pocket is positioned within the cap body. The insert opening traverses through the cap body into the insert pocket. The heating pad is removably positioned within the insert pocket through the insert opening. In the preferred embodiment of the present invention, the heating pad insert can be made out of a microwave safe material such as, but not limited to cotton or any other suitable material. The removable heating pad insert is separable from the cap body, allowing the cap body to be washed by itself without damaging the heating pad insert. The heating pad insert is re-heatable through a microwave, allowing for multiple uses.

DETAIL DESCRIPTIONS OF THE INVENTION

Figure 1:
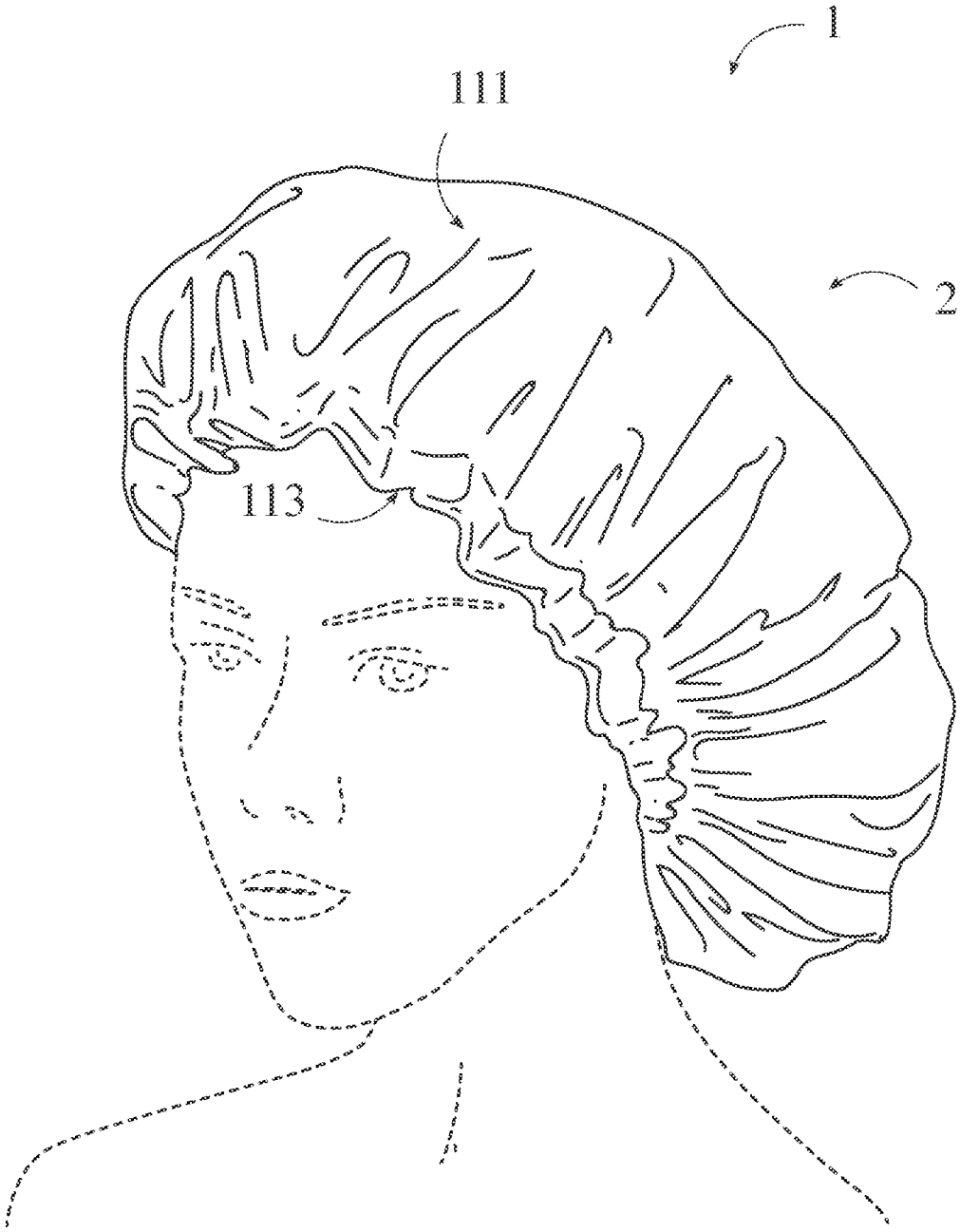
FIG. 1 is a perspective view of the present invention being worn on a user.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

In reference to FIGS. 1-6, the present invention is a headwear with heatable insert 1 that comprises, a cap body 11, an insert pocket 12, an insert opening 13, and a heating pad insert 14. In the preferred embodiment of the present invention, the headwear with heatable insert 1 may take the form of a heat cap that is suitable for various treatment and therapeutic applications. In the preferred embodiment of the present invention, the headwear with heatable insert 1 is re-usable, allowing the user to separate the heating pad insert 14 from the cap body 11. This allows the user to re-heat the heating pad insert 14 through a suitable heating element such as a microwave. Additionally, this allows the user to wash the cap body 11 separate from the heating pad insert 14. In the preferred embodiment of the present invention, the cap body 11 can be made out of a washable material, such as, but not limited to cotton or any other suitable material.

Figure 3:
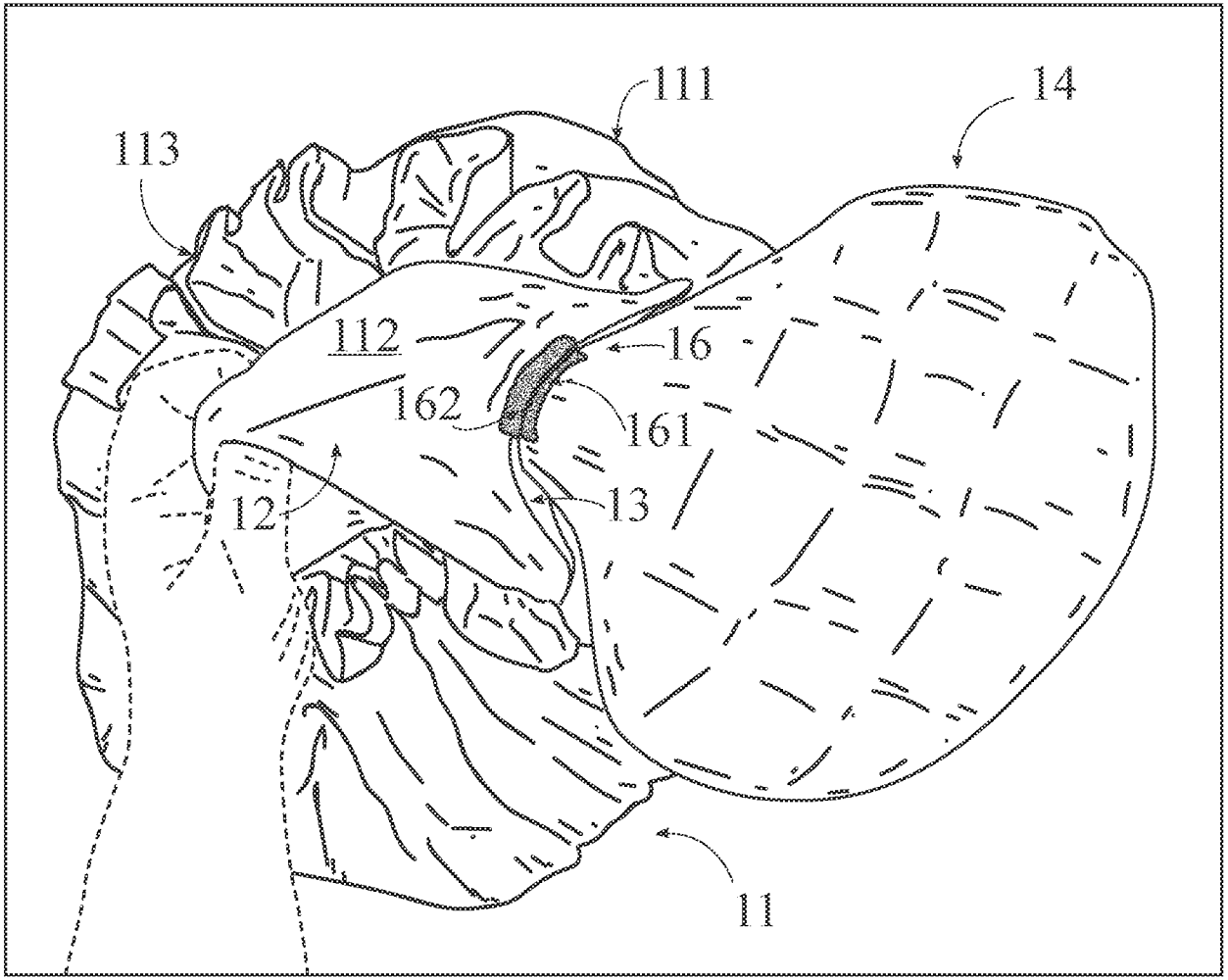
FIG. 3 is a detailed view of the present invention that shows a heating pad insert removed from an insert pocket.

In the preferred embodiment of the present invention, the insert pocket 12 is positioned within the cap body 11, as shown in FIG. 3. The insert opening 13 traverses through the cap body 11 into the insert pocket 12. The heating pad is removably positioned within the insert pocket 12 through the insert opening 13. In the preferred embodiment of the present invention, the heating pad insert 14 can be made out of a microwave safe material such as, but not limited to cotton or any other suitable material.

Figure 2:
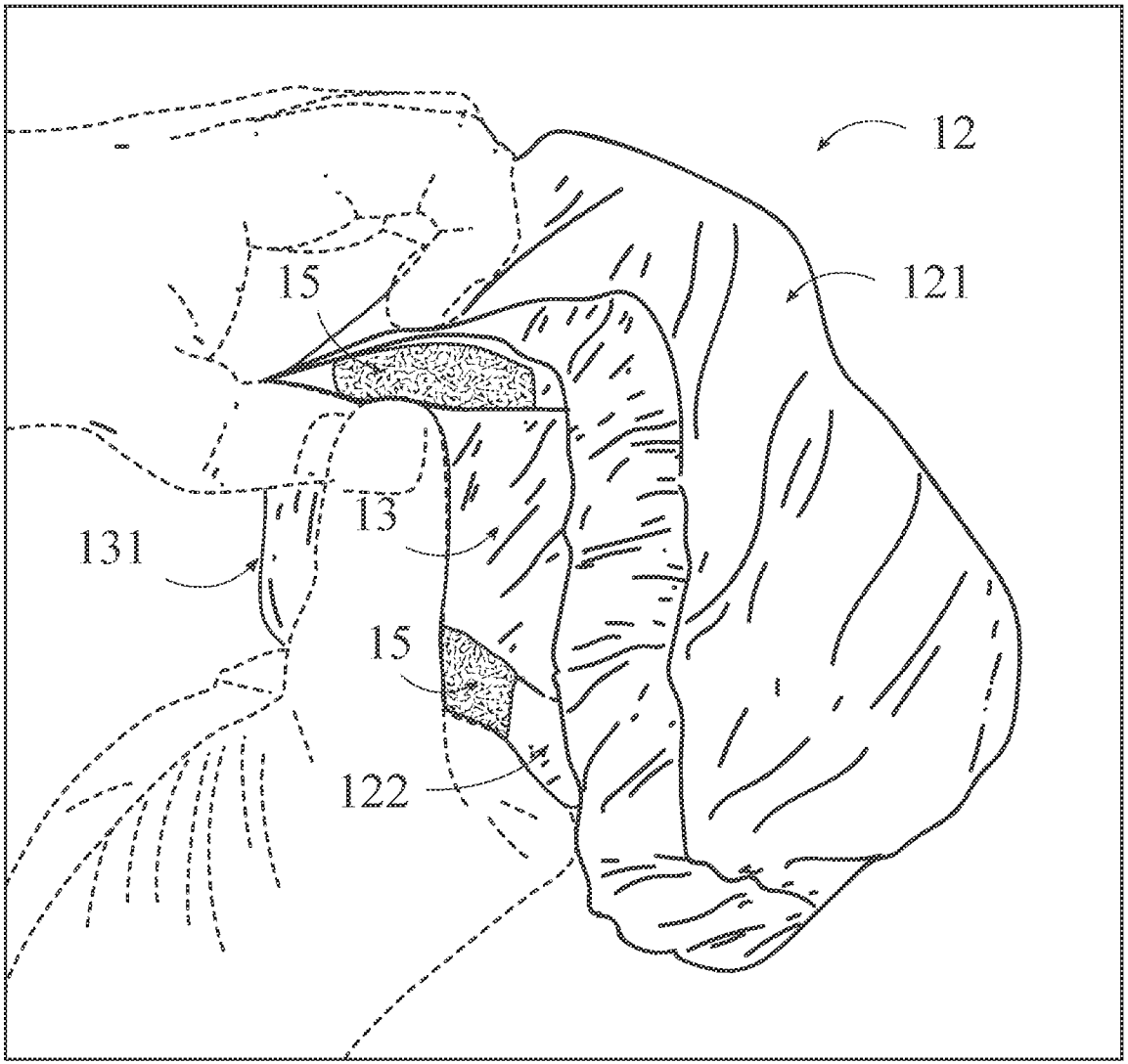
FIG. 2 is detailed view of the present invention that shows an insert pocket opening.

In the preferred embodiment of the present invention, the cap body 11 comprises an outer fabric layer 111, an inner fabric layer 112, and an elastic rim 113, as shown in FIGS. 2-3. The outer fabric layer 111 and the inner fabric layer 112 are each perimetrically connected adjacent to the elastic rim 113. The insert opening 13 traverses through the inner fabric layer 112. The heating pad insert 14 is removably positioned between the inner fabric layer 112 and the outer fabric layer 111. In the preferred embodiment of the present invention, the outer fabric layer 111 can be made out of and suitable durable and washable material, such as, but not limited cotton or any other suitable material. In the preferred embodiment of the present invention, the inner fabric layer 112 can be made out of any suitable durable and washable material with heat dispersal properties, such as, but not limited to cotton or any other suitable material. In the preferred embodiment of the present invention, the elastic rim 113 may take the form of an elastic band that secures the cap body 11 along the users head.

In the preferred embodiment of the present invention, the cap body 11 further comprises an elastic rim 113. The insert pocket 12 comprises a first pocket layer 121 and a second pocket layer 122, as shown in FIG. 2. The first pocket layer 121 and the second pocket layer 122 are perimetrically connected to the outer fabric layer 111 through the elastic rim 113. The insert opening 13 traverses through the second pocket layer 122. The heating pad insert 14 is removably positioned between the first pocket layer 121 and the second pocket layer 122. In the preferred embodiment of the present invention, the first pocket layer 121 and the second pocket layer 122 may take the form of the interior layers of the cap body 11, forming the insert pocket 12.

In the preferred embodiment of the present invention, the heating pad insert 14 comprises a heating pad body 141, a heated media 142, and a plurality of heating media compartments 143, as shown in FIGS. 3-6. The plurality of heating media compartments 143 is distributed about the heating pad body 141. The heated media 142 is positioned within the plurality of heating media compartments 143. In the preferred embodiment of the present invention, the heated media 142 is flax seed heating media, but can be any other suitable type of microwavable heating media. In the preferred embodiment of the present invention, the heating media compartments may take the form of sewn in compartments along the heating pad body 141. This allows the heating media to be evenly distributed along the heating pad body 141.

The headwear with heatable insert 1 further comprises an insert opening fastener 15, as shown in FIG. 2. The insert opening 13 comprises an insert opening brim 131. The insert opening brim 131 is perimetrically positioned along the insert pocket 12, where the insert opening brim 131 delineates the insert opening 13. The insert opening fastener 15 is perimetrically connected along the insert opening brim 131. In the preferred embodiment of the present invention, the insert opening fastener 15 is a hook and loop fastener but can be any other suitable type of fastener such as, but not limited to button fasteners, magnets, or any other suitable fastener to close the insert opening 13.

Figure 4:
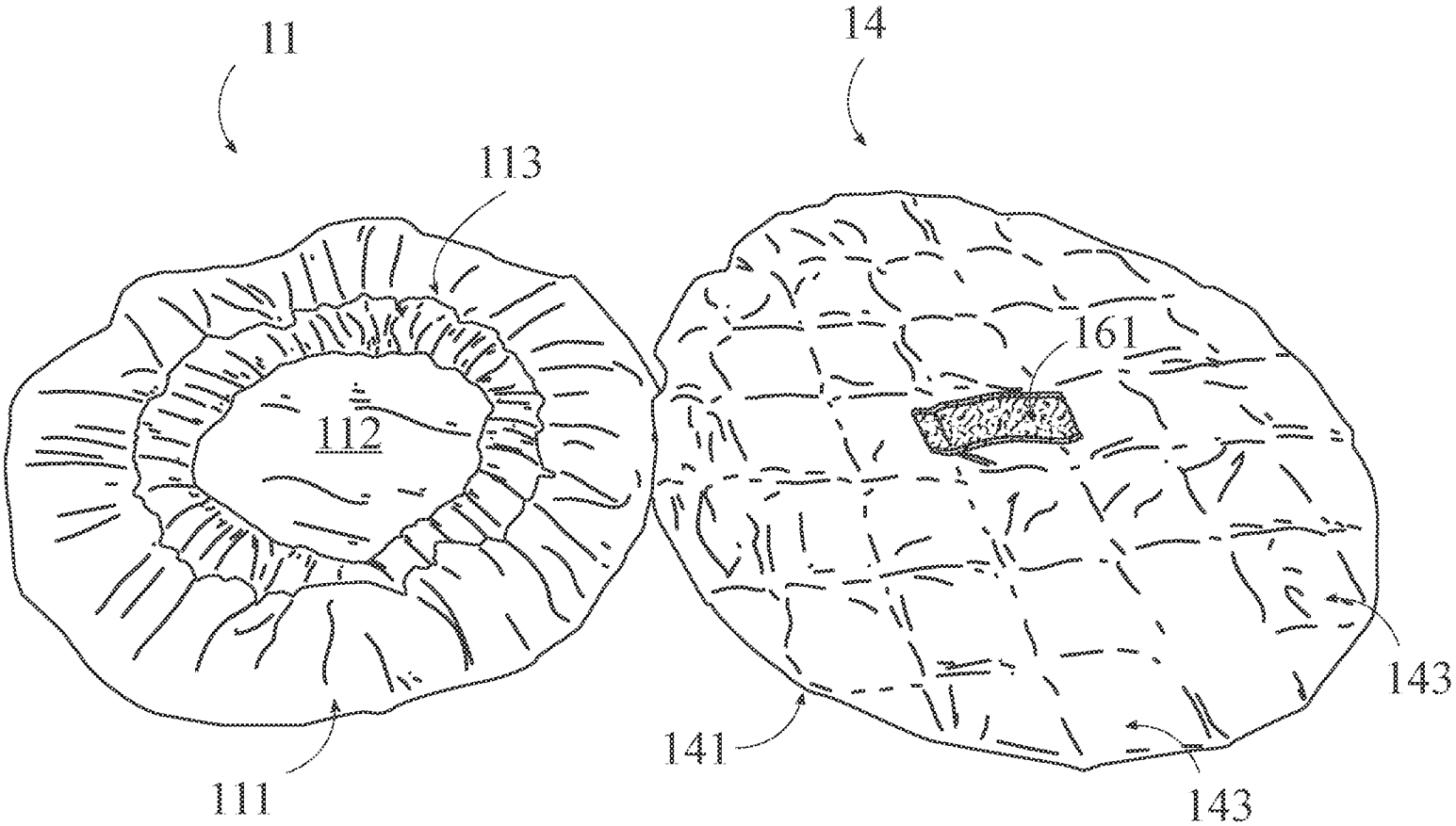
FIG. 4 is perspective view of the present invention that shows the heating pad insert and a cap body completely separated from each other.
Figure 5:
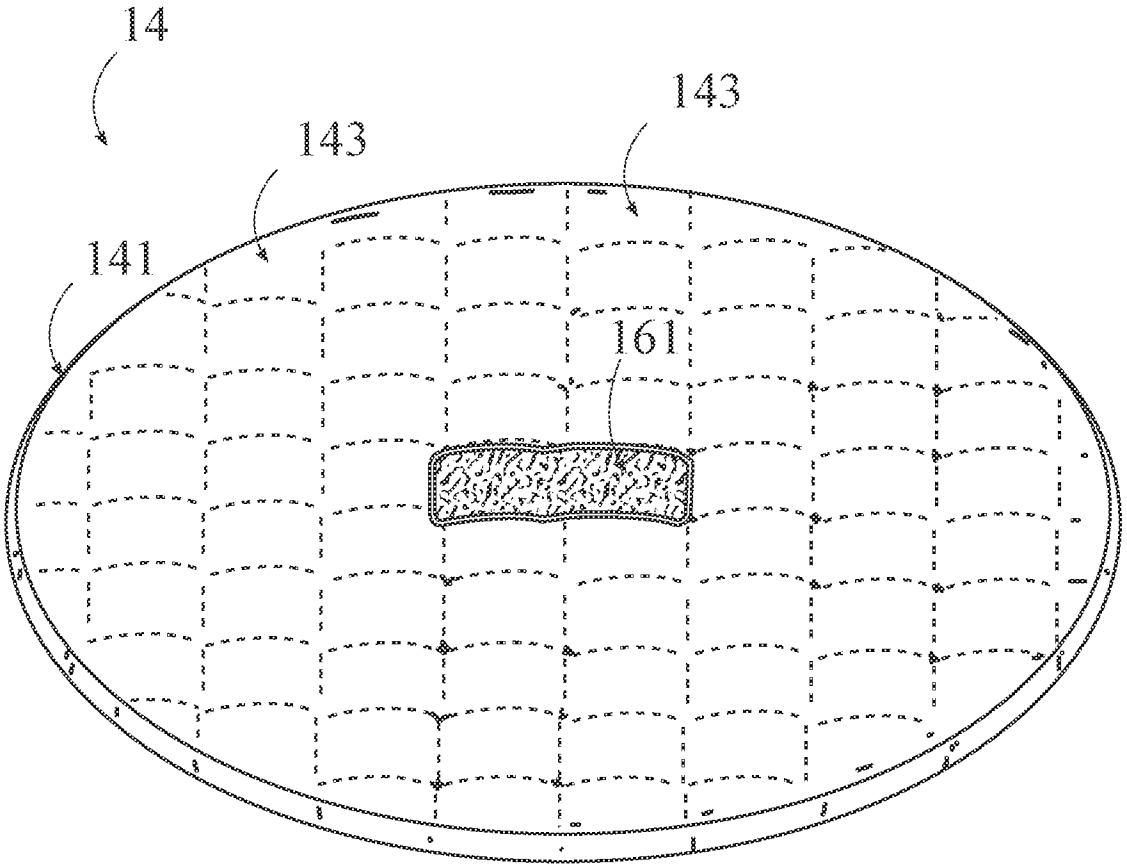
FIG. 5 is a perspective view of the heating pad insert.
Figure 6:
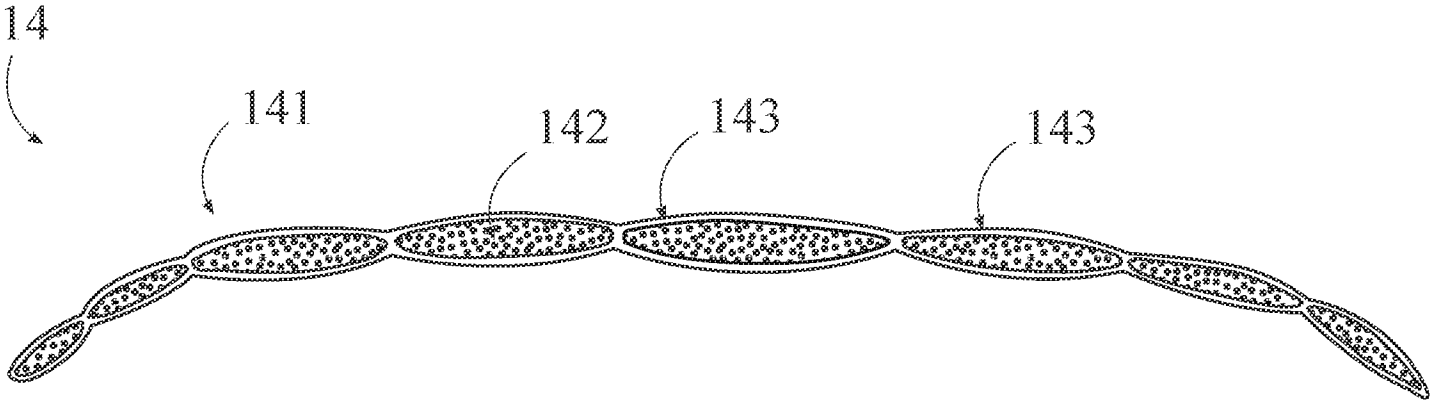
FIG. 6 is an internal view of the heating pad insert.

The headwear with heatable insert 1 further comprises an insert pocket fastener 16, as shown in FIGS. 3-5. The insert pocket fastener 16 comprises a first pocket fastener portion 161 and a second pocket fastener portion 162. The first pocket fastener portion 161 is connected adjacent to the insert pocket 12. The second pocket fastener portion 162 is connected adjacent to the heating pad insert 14. The insert pocket 12 and the heating pad insert 14 is removably attached to each other through the insert pocket fastener 16. In the preferred embodiment of the present invention the insert pocket fastener 16 is a hook and loop fastener. In the preferred embodiment of the present invention, the insert pocket fastener 16 is a hook and loop fastener but can be any other suitable type of fastener such as, but not limited to button fasteners, magnets, or any other suitable fastener to removably attach the insert pocket 12 to the heating pad insert 14.

Although the invention has been explained in relation to its preferred embodiment, it is to be understood that many other possible modifications and variations can be made without departing from the spirit and scope of the invention as hereinafter claimed.

What is claimed is:

1. A headwear with heatable insert comprising:
a cap body;
an insert pocket;
an insert opening;
a heating pad insert;
the insert pocket being positioned within the cap body;
the insert opening traversing through the cap body into the insert pocket;
the heating pad being removably positioned within the insert pocket through the insert opening;
an insert opening fastener;
the insert opening comprising an insert opening brim;
the insert opening brim being perimetrically positioned along the insert pocket, wherein the insert opening brim delineates the insert opening; and
the insert opening fastener being perimetrically connected along the insert opening brim.

2. The headwear as claimed in claim 1 comprising:
the cap body comprising an outer fabric layer, an inner fabric layer, and an elastic rim;
the outer fabric layer and the inner fabric layer being perimetrically connected adjacent to the elastic rim;
the insert opening traversing through the inner fabric layer; and
the heating pad insert being removably positioned between the inner fabric layer and the outer fabric layer.

3. The headwear with heatable insert as claimed in claim 1 comprising:
an elastic rim;
the insert pocket comprising a first pocket layer and a second pocket layer;
the first pocket layer and the second pocket layer being perimetrically connected to the outer fabric layer through the elastic rim;
the insert opening traversing through the second pocket layer; and
the heating pad insert being removably positioned between the first pocket layer and the second inner pocket layer.

4. The headwear with heatable insert as claimed in claim 1 comprising:
the heating pad insert comprising a heating pad body, a heated media, and a plurality of heating media compartments;
the plurality of heating media compartments being distributed about the heating pad body; and
the heated media being positioned within the plurality of heating media compartments.

5. The headwear with heatable insert as claimed in claim 1 comprising:

an insert pocket fastener;

an insert pocket fastener comprising a first pocket fastener portion and a second pocket fastener portion;

the first pocket fastener portion being connected adjacent to the insert pocket;

the second pocket fastener portion being connected adjacent to the heating pad insert; and the insert pocket and the heating pad insert being removably attached to each other through the insert pocket fastener.

6. The headwear with heatable insert as claimed in claim 1 wherein the insert opening fastener is a hook and loop fastener.

7. The headwear with heatable insert as claimed in claim 5 wherein the insert pocket fastener is a hook and loop fastener.

* * * * *